US010407147B1

(12) United States Patent
Benedi

(10) Patent No.: US 10,407,147 B1
(45) Date of Patent: Sep. 10, 2019

(54) FLOAT-BOAT ADAPTER

(71) Applicant: Hector Joaquin Benedi, Tavernier, FL (US)

(72) Inventor: Hector Joaquin Benedi, Tavernier, FL (US)

(73) Assignee: Hector Joaquin Benedi, Tavernier, FL (US)

( * ) Notice: Subject to any disclaimer, the term of this patent is extended or adjusted under 35 U.S.C. 154(b) by 489 days.

(21) Appl. No.: 14/998,817

(22) Filed: Feb. 22, 2016

(51) Int. Cl.
*B63H 16/08* (2006.01)
*B63H 5/02* (2006.01)
*B63B 35/73* (2006.01)

(52) U.S. Cl.
CPC ..... *B63H 16/08* (2013.01); *B63B 35/73* (2013.01); *B63H 5/02* (2013.01)

(58) Field of Classification Search
CPC .... B63H 16/08; B63H 2016/085; B63H 5/02; B63B 35/73; B63B 35/79
USPC ..... 440/21, 31, 95, 96
See application file for complete search history.

(56) References Cited

U.S. PATENT DOCUMENTS 2,282,745 A * 5/1942 Preston ..... B60F 3/0007 114/344
3,809,003 A * 5/1974 Foldvari ..... B63B 35/79 440/29
3,965,843 A * 6/1976 Smith ..... B63H 1/34 180/9.26
4,128,073 A * 12/1978 Rossmann ..... B63H 1/34 416/7
6,595,813 B1 * 7/2003 Lekhtman ..... B63H 16/12 440/21
7,104,852 B1 * 9/2006 Tsui ..... B63H 16/12 114/61.1

FOREIGN PATENT DOCUMENTS

EP 1736401 A1 * 12/2006 ..... B62K 3/002
FR 2740424 A1 * 4/1997 ..... B63H 16/08
FR 3035860 A1 * 11/2016

* cited by examiner

*Primary Examiner* — Ruth Ilan

(57) ABSTRACT

An aftermarket adaptor apparatus for a float-board is disclosed. My invention permits a user to adapt a conventional buoyant water float-board (typically a "stand-up paddle-board", surf board, or other floatable device), to effectively convert it into a foot-propelled exercise board. The adapted float-board allows a user to travel across, over, and through water by the action and means of the user's feet treading and ambulating upon a treadmill integral to said adaptor apparatus (after its attachment onto said float-board). In practice, the treadmill is affixed onto and over the upper surface of the float-board at the time of the adapter being attached. Accordingly, the affixed adaptor upgrades a simple float-board for treadmill propulsion through the water.

The adapted float-board permits a user to "self-propel" over, across, and through a body of water. This is accomplished by (1) the user attaching said adapter securely onto said float-board, (2) the user positioning the adaptor in place by strapping down the adaptor, (3) the user placing the adapted float-board into the water, and then while afloat and getting underway, (4) the user balancing and standing on top of and treading upon the adaptor's integral foot-actuated treadmill which is suspended over the buoyant coupled assembly comprising the original float-board with its attached propulsion adaptor.

4 Claims, 1 Drawing Sheet

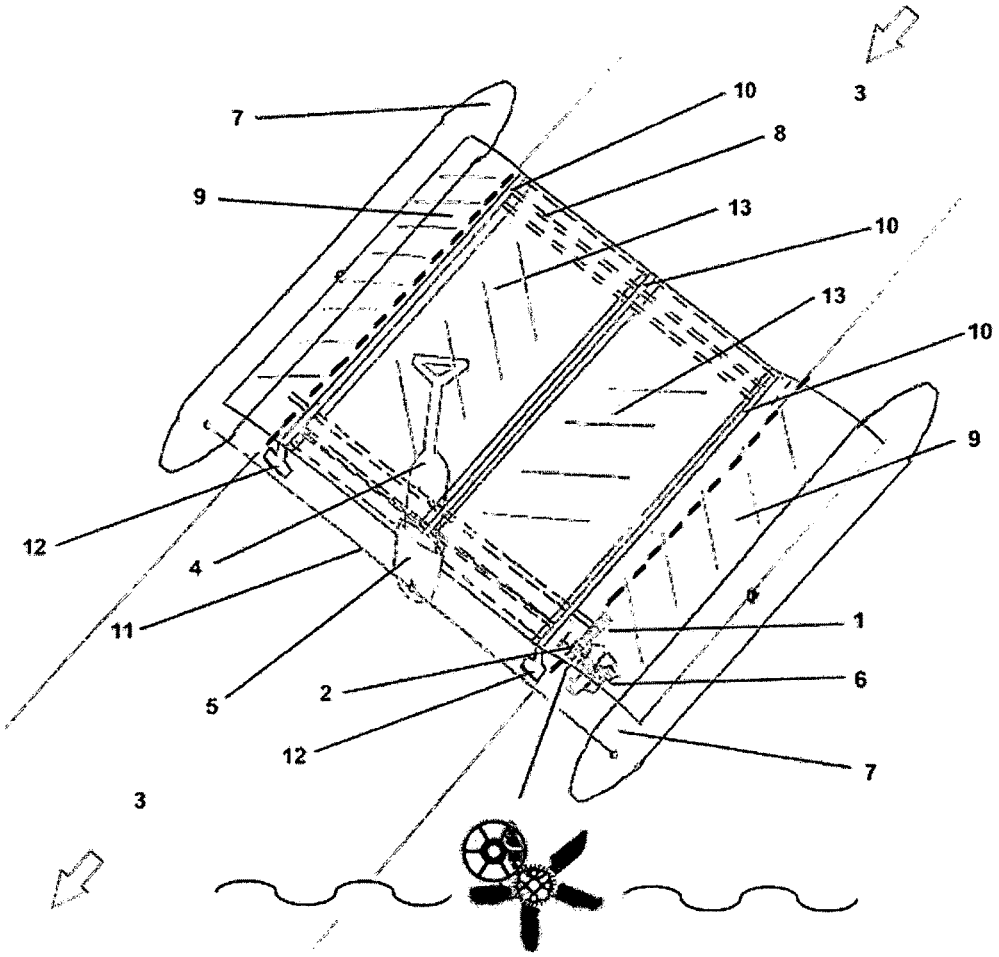
7
10
3
8
9
13
10
13
10
9
12
4
11
1
2
6
5
12
7
3

FLOAT-BOAT ADAPTER

FIELD OF THE INVENTION

The field of the invention is user-propelled personal watercraft. Typical flotation devices of my invention are used for fun, for leisure and/or for exercising on the water. More particularly, my invention combines a leisure personal watercraft and a retrofitting adaptor to mount exercise machinery atop the watercraft.

BACKGROUND OF THE INVENTION

The field of leisure, recreational and sport watercraft is very diverse, but to date the inventor is unaware of any devices that are comparable to the present invention. This is an active area and a large market. Exercise machines are also a very active, diversified, and well developed leisure market. Heretofore, to my knowledge there has been no directly-comparable adaptor devices for adapting personal watercraft-float-boards, "stand-up paddleboards" and the like-that allow a user to literally "walk on water". This is accomplished by the instant invention by intersecting personal watercraft with exercise machinery, combining them both in one device.

SUMMARY OF THE INVENTION

The present invention comprises a foot-propelled float-board for leisure, entertainment, sport and exercise applications. In current practice, a wide variety of float-boards are well-received by users and many different but comparable versions exist, depending upon a user's budget and intentions for use.

BRIEF DESCRIPTION OF THE FIGURE

The FIGURE shows an Adaptor apparatus affixed onto a typical float-board

DETAILED DESCRIPTION OF THE INVENTION

Reference Numerals 1—Drive Gear—Drive Gears drive Driven Gears: Driven Gear extensions terminate in further driven Paddlewheels (i.e., Paddlewheels are driven by Driven Gears and initially driven by Drive Gears extended at ends of 3 treadmill rollers. Paddlewheels are driven and propel the user through the water, since Paddlewheels are effectively "Water Driving Paddles." Paddlewheels are all driven by their individual Drive/Driven gear subassemblies . . . in summary, Paddlewheels are ultimately driven forward or backward by the user treading on the treadmill forward or backward.

2—Driven Gear—3:1 Gearing for mechanical advantage (Drive Gears are all connected to Driven Gears and then to Propulsion Paddlewheels (mechanical advantage of Drive Gear: Driven Gear, are shown here to be 3:1, but could be otherwise configured as specified by user).

3—Float-Board—Typical Float Board suited for adaptor: standard flotation devices (very diverse)

4—Paddle—Telescoping paddle for balance and steering. Can also be removed from holder and used in a traditional manner to propel float-board.

5—Paddle-Holder—Integral to adapter is a "Bowsprit Paddle" device for changing directions to Port or Starboard, used for navigating the adapted float-board according to user's intended course . . . but also attached to control arms for directional control of outrigger/pontoon/rudders, which are moved in tandem (both toward port or both toward starboard). These further directional change and course change of the moving float-board, while being propelled and underway. Said outrigger/pontoon/rudders are attached at a center pivot point to a splash-guard covering the gear and paddle wheels. Outrigger/pontoon/rudders provide extra buoyancy, distribute weight and improve float-board stability.

6—Paddle-Wheel—Converts users' energy into propulsion above and through a body of water.

7—Pontoon/Outrigger/Rudder—Adds buoyancy to float-board by distributing weight and lowering center of gravity. Serves as a rudder for directional change of float-board above and through a body of water.

8—Rollers—Treadmill-drive Rollers (axles) & "Drive Gears"—all Turn "Driven Gears"—which further drive "Propulsion Paddlewheels" through water: To be specific, 3 of the treadmill support rollers are drive rollers (axles) which in turn pass through 3 longitudinal stanchions; both ends of each of 3 Rollers terminate in "Drive Gears" (3 rollers×2 drive gears each=6 total rolling "Drive Gears"); each of these 3×2 Drive Gears are suspended over interlocking adjacent 3×2=6 "Driven Gears"; each of the 6 Driven Gears are extended collinearly and directly interconnected into 6 (further-driven) Paddlewheels (water-propulsion "paddles").

9—Splash Guard—Covers drive gears, driven gears and paddle-wheels. Keeps water from splashing onto float-board and connects adapter mechanism to the Pontoon/Outrigger/Rudder.

10—Stanchion—Adaptor's Frame Suspends Treadmill over upper surface of float-board (longitudinal stanchions with holes for treadmill axles/rollers pass-through, three of which terminate in drive gears) 11—Steering Link Bar—Moves the Pontoon/Outrigger/Rudder to port or starboard in response to users tilting of paddle to left or right.

12—Tie-Down Bracket—Adaptor Attachment Means (attaching, belting, or other fixation means)—Tread Belt—Port and starboard tread belts cover rollers and transfer users ambulating motion to rollers for propulsion of float-board above and through a body of water.

13—tread Belt—Port and starboard tread belts cover rollers and transfer user's ambulating motion to rollers for propulsion of float-board above and through a body of water.

I claim:

1. A float-board adaptor apparatus for coupling onto and adapting a float-board to provide user self-propulsion through the water, said adaptor comprising:

a main assembly having a foot-propelled treadmill exercise machine adapted to be attached to the float-board and suspended above an upper surface of the float-board when the adaptor is attached to said float-board; wherein said treadmill allows a user to stand atop the adapted float-board, balance while afloat and foot-propel themselves over and through the water by walking forward or backward upon said treadmill in order to turn at least one paddlewheel by a respective geared subassembly;

a pair of pontoons, each connected at a center pivot point to a splash-guard covering the at least one paddlewheel and respective geared subassembly;

a paddle assembly connected to the pontoons by a steering link bar and further comprising a paddle; wherein the paddle is tilt-able to pivot the pontoons in tandem about their respective pivot point to steer the float-board, said paddle further being removable from a holder of the assembly to use as a paddle for propulsion.

2. The float-board adaptor apparatus of claim 1, wherein the main assembly further comprises a tie-down bracket for securing the main assembly to the float board.

3. The float-board adaptor apparatus of claim 1, wherein the main assembly is adapted to suspend the treadmill over the upper surface of the float board by longitudinal stanchions which receive axles of the treadmill in holes in the stanchions.

4. The float-board adaptor apparatus of claim 3, wherein the at least one paddlewheel and respective geared subassembly comprises six paddlewheels and geared subassemblies and the treadmill axles which pass through the holes in the stanchions include three that terminate at each end in drive gears for a respective one of the geared subassemblies.

* * * * *